US011483920B2

(12) United States Patent
Hannon et al.

(10) Patent No.: US 11,483,920 B2
(45) Date of Patent: Oct. 25, 2022

(54) HIGH EFFICIENCY NORMAL CONDUCTING LINAC FOR ENVIRONMENTAL WATER REMEDIATION

(71) Applicant: JEFFERSON SCIENCE ASSOCIATES, LLC, Newport News, VA (US)

(72) Inventors: Fay Hannon, Bjärred (SE); Robert Rimmer, Yorktown, VA (US); Shaoheng Wang, Yorktown, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 0 days.

(21) Appl. No.: 17/120,178

(22) Filed: Dec. 13, 2020

(65) Prior Publication Data

US 2021/0274633 A1 Sep. 2, 2021

Related U.S. Application Data

(60) Provisional application No. 62/947,908, filed on Dec. 13, 2019.

(51) Int. Cl.

| | |
|---|---|
| ***H05H 9/04*** | (2006.01) |
| ***H05H 7/02*** | (2006.01) |
| ***H05H 7/18*** | (2006.01) |

(52) U.S. Cl.

CPC ..... *H05H 9/04* (2013.01); *H05H 7/02* (2013.01); *H05H 7/18* (2013.01)

(58) Field of Classification Search

None

See application file for complete search history.

(56) References Cited

U.S. PATENT DOCUMENTS 4,972,420 A * 11/1990 Villa ..... H01S 3/0903 315/505
4,975,917 A * 12/1990 Villa ..... H05H 7/00 372/5
5,227,701 A * 7/1993 McIntyre ..... H01J 25/36 315/5.41

(Continued)

OTHER PUBLICATIONS

John Wallace "EKOLAS research project leads to novel laser bars with 70% wall-plug efficiency" Jul. 9, 2020 Lasers and Sources.*

*Primary Examiner* — Srinivas Sathiraju

(57) ABSTRACT

A continuous wave (CW) electron accelerator for the treatment of industrial streams including an electron beam source, a modified high efficiency slot coupled cavity, at least one focusing magnet positioned surrounding the accelerator to contain the beam in the accelerator, an efficient radio frequency power supply means for supplying power of a radio frequency to the cavity to induce a TM01 accelerating mode in the cavity, an electron beam spreader or raster, a fixed magnet array or two-dimensional scanning magnet for deflecting the accelerated beam into a desired shape, and an exit window for extracting the deflected electron beam. The accelerator includes a graded-beta cavity to enable use with a low-power pulsed electron source. The accelerator benefits from a low wall-power loss accelerating cavity that is energized with efficient RF sources, enabling it to be operated in continuous wave mode.

12 Claims, 6 Drawing Sheets

(56) References Cited

U.S. PATENT DOCUMENTS 6,137,246 A * 10/2000 Suzuki ..... G21K 1/14 250/251
7,656,236 B2 * 2/2010 Williams ..... H03L 7/107 331/11
7,898,193 B2 * 3/2011 Miller ..... H05H 7/22 315/505
8,076,853 B1 * 12/2011 Caryotakis ..... H01J 25/10 315/5
8,130,045 B1 * 3/2012 Allison ..... H03L 7/081 331/6
8,232,749 B1 * 7/2012 Barov ..... H05H 7/18 315/505
9,023,765 B1 * 5/2015 Rimmer ..... H01J 37/32009 505/450
9,029,796 B2 * 5/2015 Okihira ..... B23K 26/32 250/397
9,386,682 B2 * 7/2016 Tantawi ..... H05H 7/02
9,398,681 B2 * 7/2016 Tantawi ..... H05H 9/044
9,402,298 B2 * 7/2016 Sugahara ..... H05H 7/08
9,589,757 B1 * 3/2017 Hannon ..... B24B 37/042
9,655,227 B2 * 5/2017 Wang ..... H05H 7/18
9,671,520 B2 * 6/2017 Botto ..... H05G 2/00
9,673,015 B2 * 6/2017 Jiang ..... H01J 25/10
9,825,214 B1 * 11/2017 Reeves ..... H01L 31/18
9,837,599 B1 * 12/2017 Reeves ..... H01L 31/18
9,913,360 B1 * 3/2018 Antipov ..... H05H 7/02
10,236,090 B1 * 3/2019 Areti ..... H05H 7/001
10,362,666 B2 * 7/2019 Mustapha ..... H05H 9/044
10,363,439 B2 * 7/2019 Amaldi ..... H05H 9/041
10,568,196 B1 * 2/2020 Nguyen ..... H05H 9/02
10,714,225 B2 * 7/2020 Ylimaki ..... G21G 1/10
11,160,158 B1 * 10/2021 Nguyen ..... H05H 9/048
2003/0179784 A1 * 9/2003 Minehara ..... H05H 7/20 372/2
2006/0039417 A1 * 2/2006 Biedron ..... H01S 1/005 372/2
2006/0170381 A1 * 8/2006 Amaldi ..... H05H 13/00 315/502
2006/0251217 A1 * 11/2006 Kaertner ..... H05G 2/00 378/119
2009/0302785 A1 * 12/2009 Miller ..... H05H 9/04 315/505
2012/0194266 A1 * 8/2012 Galdemard ..... H04L 27/2338 329/304
2012/0262333 A1 * 10/2012 Trummer ..... H05H 7/22 342/146
2015/0257247 A1 * 9/2015 Hannon ..... H05H 7/001 315/501
2015/0366046 A1 * 12/2015 Wang ..... H05H 7/18 315/504
2016/0014876 A1 * 1/2016 Tantawi ..... H01P 1/207 315/39
2016/0071681 A1 * 3/2016 Jiang ..... H01J 23/0275 315/5.38
2016/0249444 A1 * 8/2016 Yamamoto ..... H05H 9/00
2017/0093113 A1 * 3/2017 Musumeci ..... H01S 3/0959
2017/0238408 A1 * 8/2017 Lombardi ..... H05H 9/045 315/505
2017/0301409 A1 * 10/2017 Vandrie ..... G21B 1/052
2018/0343733 A1 * 11/2018 Mustapha ..... H05H 7/04
2019/0098741 A1 * 3/2019 Ciovati ..... H05H 7/02
2021/0274633 A1 * 9/2021 Hannon ..... H05H 7/02

* cited by examiner

HIGH EFFICIENCY NORMAL CONDUCTING LINAC FOR ENVIRONMENTAL WATER REMEDIATION

This application claims the priority of Provisional U.S. Patent Application Ser. No. 62/947,908 filed Dec. 13, 2019.

The United States Government may have certain rights to this invention under Management and Operating Contract No. DE-AC05-06OR23177 from the Department of Energy.

FIELD OF THE INVENTION

The present invention relates to the treatment of various industrial materials with an electron beam, and more specifically to efficient treatment of wastewater, medical waste, sterilization, and for environmental remediation applications.

BACKGROUND

Electron accelerators are increasingly being used in industry as irradiation sources. Applications are varied from reduction of contaminants in wastewater streams and flue gasses, pathogen destruction in foods, and cooked food preparation to name a few. As demonstrated in the scientific literature, irradiation is an effective treatment method for radically reducing organic contaminants in wastewater. Irradiation of liquids and gases with electrons result in the local formation of ions and radicals, which are extremely reactive on a short timescale, allowing neutralization of contaminants. The dose required for decontamination depends on the percentage of organic compounds, but is approximately between 1 kGy and 10 kGy. The dose is proportional to the electron beam power and the mass flow rate of the substance.

Unfortunately, commercially available electron beams at present lack the efficiency, capacity and compatibility required for processing industrial liquid waste on a much larger scale; therefore a custom engineered solution is required. Typical electron accelerators used for these applications are based on DC technology, with beam power of a few hundred kW.

Studies have shown that the accelerator field is poised to have an impact in these types of applications because accelerator technology routinely in-use at the national laboratories has advanced significantly in the last 10-15 years. The report identified that a low-energy system of approximately 1 MeV, with 0.5 MW beam power with a target electrical efficiency of >50% would demonstrate an advance in technology for wastewater, medical waste, sterilization and environmental remediation applications. In order to be competitive with alternative treatment methods, the treatment cost should be less than $1/m^3$ in the case of wastewater.

Normal conducting radio-frequency cavities made from copper are the backbone of many high energy particle accelerators used for research purposes. When compared with the alternative of superconducting cavities, they are inexpensive to manufacture and are very robust with high up-times. Unfortunately, conventional RF cavities are typically operated in a pulsed mode to provide higher accelerating gradients, exhibit low electrical efficiency and low average power.

To overcome these deficiencies with conventional cavities, the present invention proposes a compact, continuous-wave (CW), high efficiency normal conducting cavity for the irradiation source. The cavity operates in PI mode standing wave (180° phase advance from cell to cell), which eliminates the need for side coupling cavities or in-line coupling cells that add complexity, while still meeting efficiency goals. Strong cell to cell coupling is provided by coupling slots in the iris walls, allowing a small beam pipe for high shunt impedance. When paired with an electron source and beam delivery system, it will deliver nominally a 0.5 MW, 1 MeV beam for irradiation purposes. The cavity frequency has been chosen to be at a common mass-produced industrial magnetron frequency so that it can benefit from their high efficiency, low capital cost and reliable supply base.

SUMMARY OF THE INVENTION

The invention is a continuous wave (CW) electron accelerator for the treatment of industrial streams that includes an electron beam source, a modified high efficiency slot coupled cavity, at least one focusing magnet positioned surrounding the accelerator to contain the beam in the accelerator, efficient radio frequency power supply means for supplying power of a radio frequency to the cavity to induce a TM01 accelerating mode in the cavity, an electron beam spreader or raster, a fixed magnet array or two-dimensional scanning magnet which deflects the accelerated beam into a desired shape, and an exit window for extracting the deflected electron beam. The accelerator is a graded-beta cavity to enable operation with a low-voltage gridded electron source. This arrangement benefits from a low wall-power loss accelerating cavity that is energized with efficient RF sources, which allows it to be operated in continuous wave mode.

BRIEF DESCRIPTION OF THE SEVERAL VIEWS OF THE DRAWING(S)

Reference is made herein to the accompanying drawings, which are not necessarily drawn to scale, and wherein:

Reference is made herein to the accompanying drawings, which are not necessarily drawn to scale, and wherein.

DETAILED DESCRIPTION OF THE INVENTION

The present invention is an efficient continuous wave (CW) industrial electron accelerator for the treatment of fluid streams in industries such as food pasteurization, sterilization, waste water remediation, oil sand treatment, and fracking fluid treatment. This application incorporates herein by reference the entire contents of U.S. Pat. No. 9,655,227, titled "Slot-Coupled CW Standing Wave Accelerating Cavity".

Figure 1:
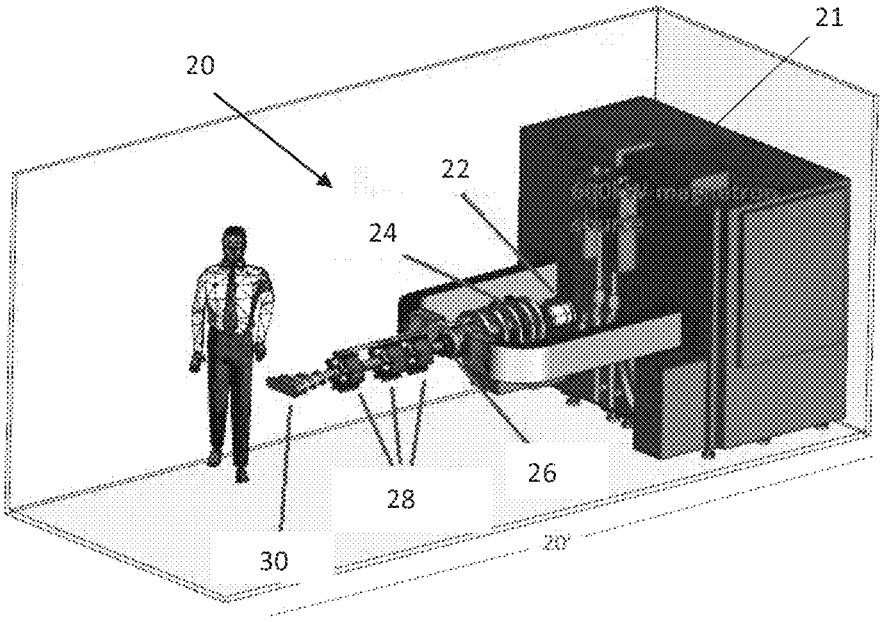
FIG. 1 is a perspective view of a container-sized continuous wave (CW) electron accelerator according to the invention, the accelerator shown in perspective with a person.

Accelerator Layout:

One consideration of this system is that it must be compact, so it can be portable and have the potential to be deployed in-the-field. FIG. 1 shows an accelerator 20 according to the invention. The accelerator fits within the volume of a standard 20' shipping container.

With reference to FIG. 1, the accelerator 20 includes an electron source 21 that produces 0.5 A of current from a gridded thermionic cathode (not shown). The cathode-anode potential is 45 kV and a 915 MHz RF signal and DC bias is applied to the grid to produce a bunched beam. The electron gun 22 and a solenoid magnet 24 both focus the beam transversely into the accelerating cavity 26. The preferred normal-conducting cavity is a graded beta, 6-cell cavity, and approximately 0.8 m long. This accelerates the electron beam to 1 MeV. With normal conductive cavities it is possible to implement solenoids along the length to ensure 100% beam transmission. Downstream, of the cavity 26 a number of quadrupole magnets 28 are used to manipulate the electrons into a flat beam transversely. The beam exits the vacuum structure via a thin foil extraction window 30. A static beam with large area and aspect ratio is assumed here rather than a raster system, though either would be acceptable. The overall length of the accelerator is about 2.5 m.

The gridded thermionic cathode provides a robust, economical and compact electron source capable of providing the high beam power and long service life necessary for the treatment of flue gasses, liquids and wastewater. This application does not have the stringent electron beam properties often required by the accelerator physics community, so achieving the beam current becomes easier, the main constraint being no significant particle losses in the structure. There are several examples of thermionic guns that are in the region of that required for this accelerator. Furthermore, it may be possible to use the thermionic gun from a conventional linear beam RF source such as a klystron or IOT. Companies L3 and CPI both have electron sources in the 30 kV region that can operate at 915 MHz. For the purpose of simulations a slightly modified Eimac/CPI style cathode at 45 kV has been assumed.

Beam Transport Simulations:

General Particle Tracer (GPT) particle tracking software was used to determine the beamline layout and simulate the additional magnets required to propagate the beam to the exit window. Multi-objective genetic optimization methods have been employed to deliver the most efficient beam transport. While the exit beam parameters such as emittance and bunch length aren't as strict as physics accelerators, it will be important to have 100% beam transmission and to control the energy spread for efficient fluid treatment. In general, 1D field maps have been used in the simulation to represent electromagnetic components and off-axis fields are derived analytically to $2^{nd}$ order. The exception was the cavity which had a 3D full complex field description.

Figure 2:
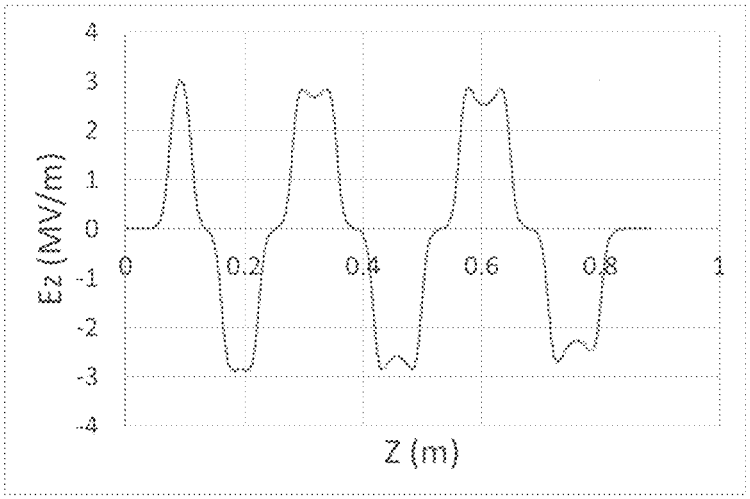
FIG. 2 is a graph depicting the on-axis 'field-flat' accelerating field with correct nose trimming.

The emission from the cathode was assumed to have a truncated cosine longitudinal profile and uniform transverse distribution from a 2 $cm^2$ circular area. As the cathode operates at high temperature (~2000C), a thermal emittance was included in the simulation. The electron gun design was generated using electrostatic solver software, and has a realistic Pierce geometry to provide transverse focusing over a 5 cm cathode-anode gap. The 45 kV electron beam from the gun is non-relativistic and dominated by space-charge forces within the bunch. A solenoid immediately following the gun is used to focus the beam into the small cavity aperture of 2.8 cm diameter. The cavity on-axis electric field map is shown in FIG. 2.

Because of the graded-β design, the cavity can be operated at a phase very close to crest. For a 1 MeV beam the peak on-axis field is 3 MV/m.

Figure 3:
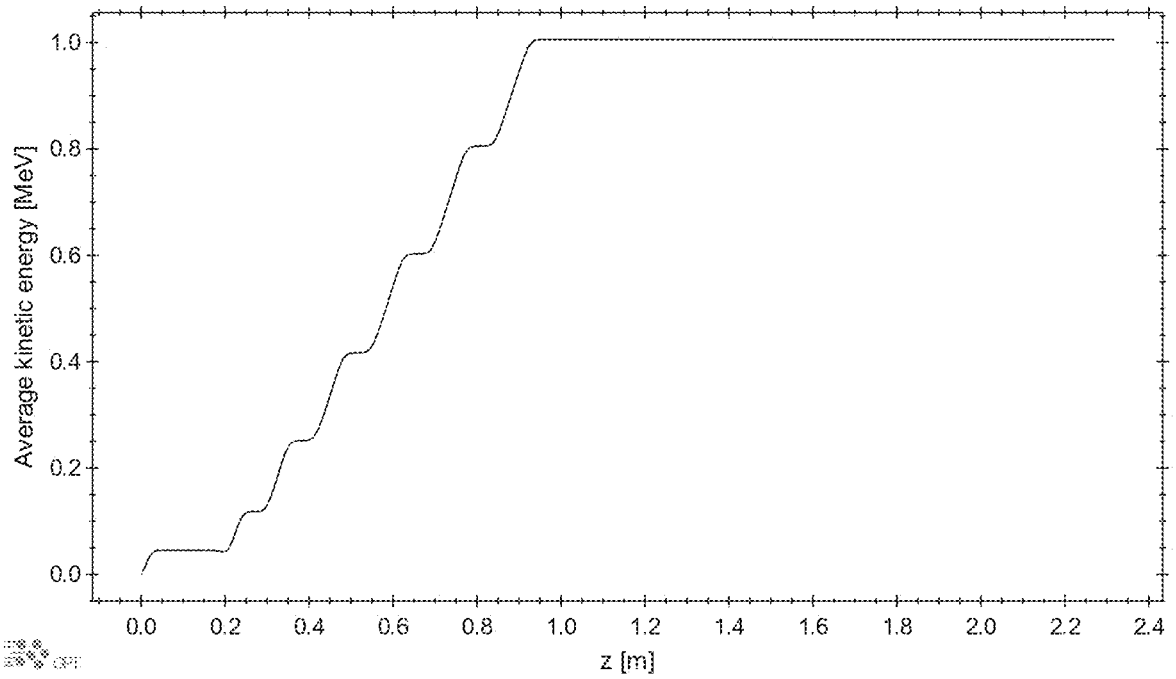
FIG. 3 is a graph depicting the energy gain through the accelerator.
Figure 4:
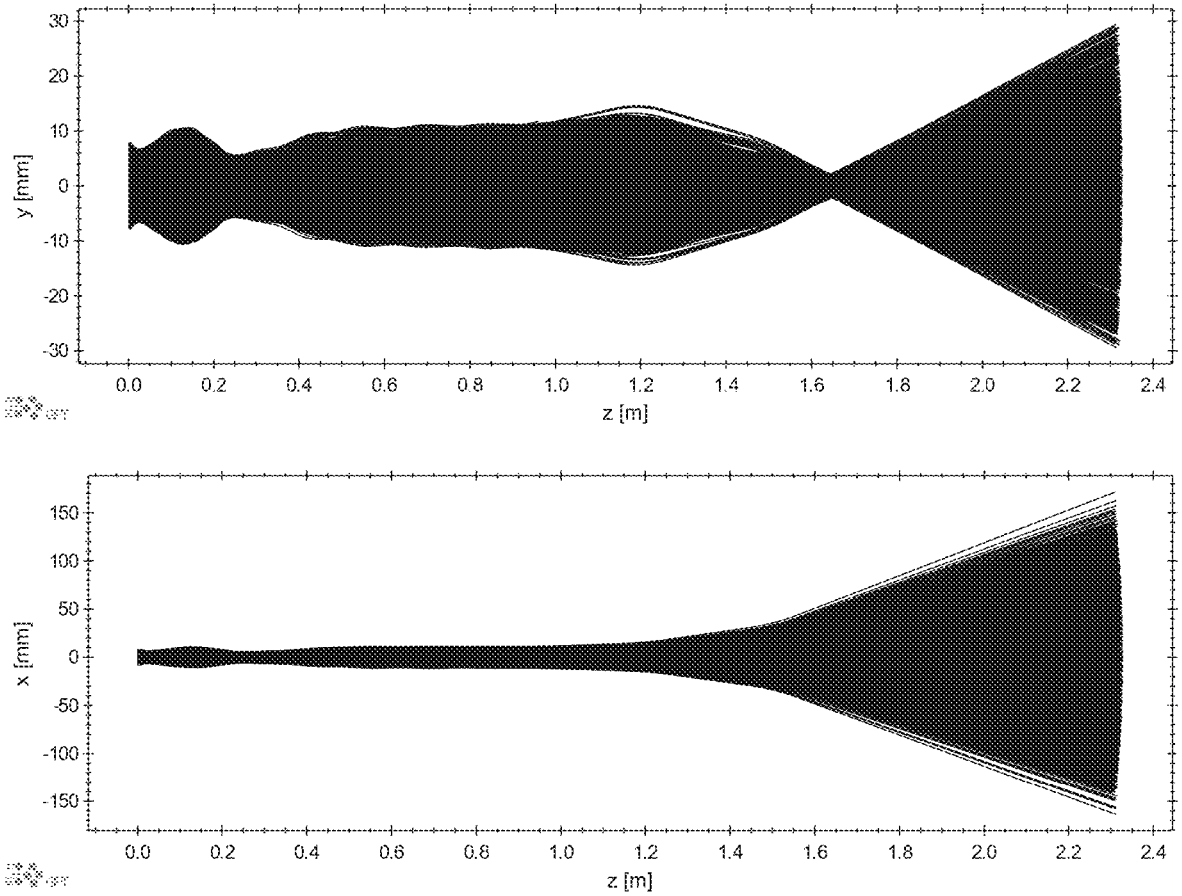
FIG. 4 is a graph depicting the transverse particle trajectories, with the cavity 0.1 m and 0.9 m from the cathode.
Figure 5:
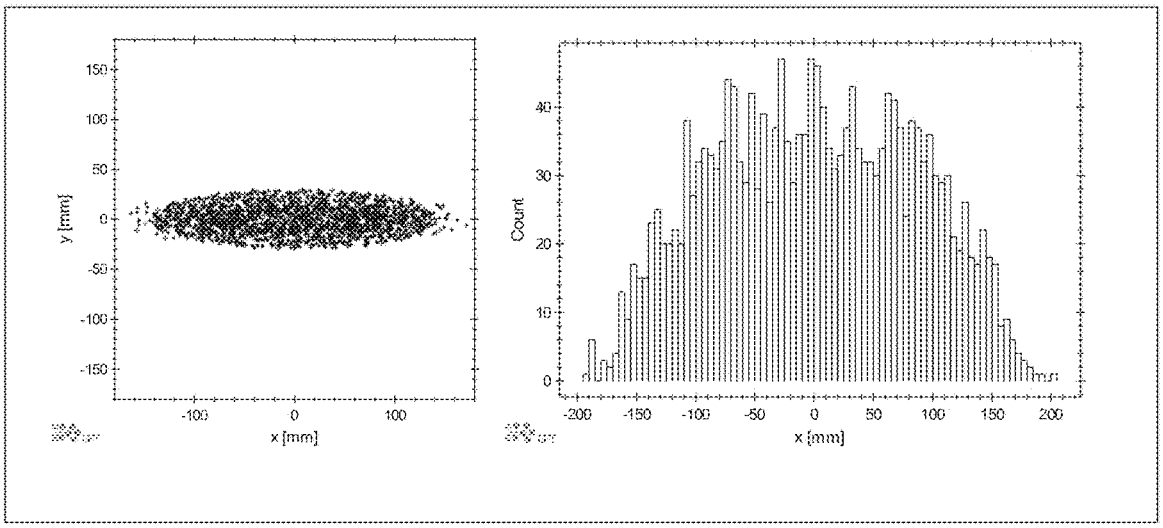
FIG. 5 depicts on the left a graph showing the beam dimensions at the exit window and, on the right, the horizontal profile of the beam.
Figure 6:
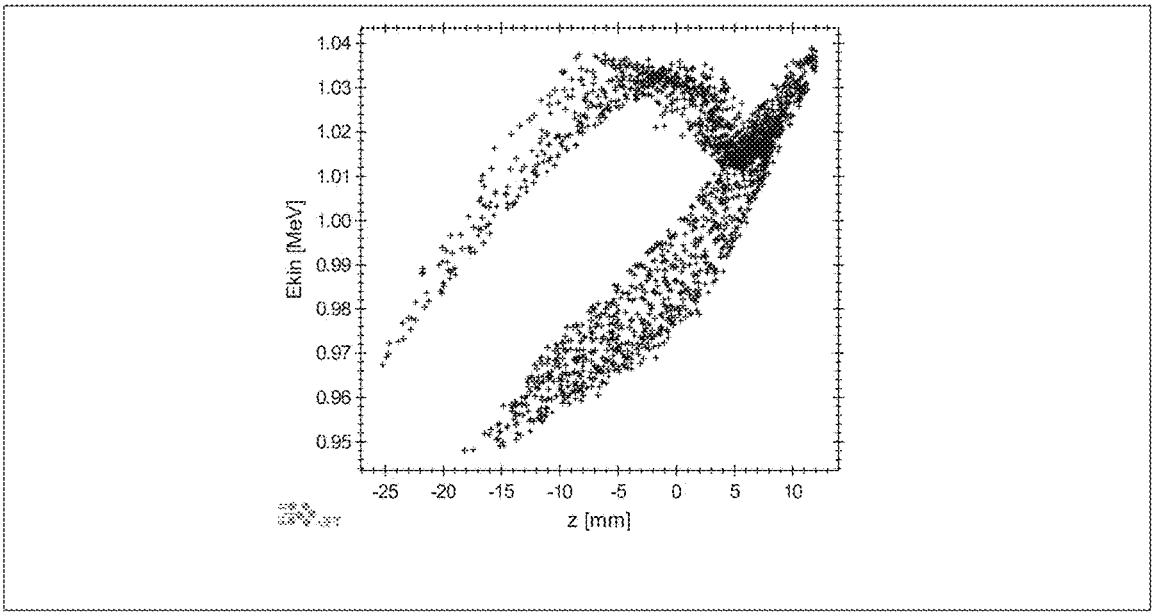
FIG. 6 is a graph depicting the energy spread at the exit window.

Simulations show that a 500 pC electron bunch, emitted from a gridded thermionic cathode under typical operation, can be accelerated to over 1 MeV without losing particles on the cavity aperture. FIG. 3 shows the energy gain through the LINAC from the cathode through the cavity. FIG. 4 shows the particle trajectories transversely in both dimensions x and y. A quadrupole doublet was used after the cavity to spread the beam to large aspect ratio, as shown in FIG. 5. This may be an attractive alternative to the conventional raster system, possibly even being implemented using permanent magnets to save operating cost and mitigate failure modes. The maximum energy spread at the beam exit window is 90 kV, shown in FIG. 6, providing a good quality beam for irradiation.

These simulations show that in this simplified case, the resulting beam is suitable for industrial purposes.

Figure 7:
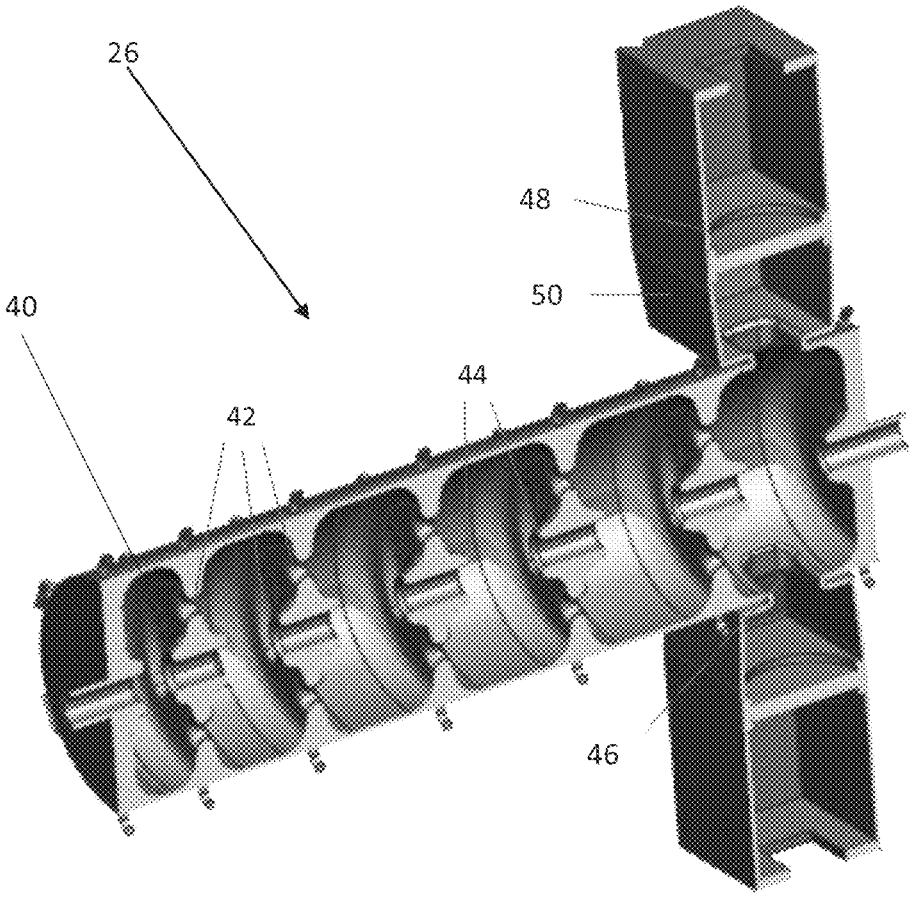
FIG. 7 is a sectional view of a graded-β accelerator cavity at 915 MHz, with the beam entering from the left.

Cavity Design:

With reference to FIG. 7, the cavity 26 is based upon a re-entrant, graded-β structure, so that low energy electrons can be captured into the cavity and accelerated to 1 MeV without phase-slipping between cells. In order to accommodate the varying β, and improve the capture and acceleration efficiency, the lengths of cells 40 increase as β increases. This improves the quality of the exiting electron beam, predominantly in terms of energy spread.

The PI mode cavity can accept a sufficient range of beam phases to accelerate the electron bunches from the gridded gun without beam loss in the structure. At maximum beam loading there is a small perturbation in the cell to cell phase advance because of the traveling-wave component of power flowing to the beam. This also changes the field flatness slightly but desired beam energy and 100% transmission can be maintained with a small shift in input phase from the gun.

Referring to FIG. 7, the shape of each cell 40 has been specifically optimized for power efficiency and reduction of peak-power on the cavity surface (thus reducing thermal stresses and permitting CW operation). The Jefferson Lab patented cavity design utilizes multiple short intra-cell coupling slots 42 to maximize the efficiency of CW operation. The slot coupling makes the LINAC very compact compared to traditional side-coupled cavities (scale shown in FIG. 1). Because of the existence of the slots, the wall currents of the accelerating mode are concentrated between slots. The maximum magnetic field occurs at the end edges of slots, and so does the highest power density of wall loss. The heat load is removed through cooling channels, internally located close to the slots. The large slot area also permits good vacuum design. The vacuum pumping port can therefore be anywhere on the cavity, in this case at the end on the waveguide transition. The capacitance and eigenfrequency of each cell is determined by the geometry of the re-entrant noses 44. Precise nose trimming can then compensate for any mechanical error of the cell geometry produced in the manufacturing process (prior to assembly) to ensure the field flatness through the cavity, shown for the ideal case with 3 MV/m peak, in FIG. 2. The sensitivity of nose trimming is 6 MHz/mm, so a machining tolerance of 0.1 mm is enough for the cavity frequency bandwidth of 1 MHz with a loaded Q of 950. The quality factor $Q_0$ of the cavity using OFC copper is at least 18278. Because of the large beam power (500 kW), the coupling Qext must be able to ensure the efficient utilization of RF power. For a good match between the (loaded) cavity and waveguide, the input coupling factor is therefore ~18 with a $Q_{ext}$ of approximately 1000. Because of the thermal conductivity of the copper cavity and strong cooling the design is insensitive to changes in field flatness due to temperature changes. Overall variations in temperature due to cooling water fluctuations can be tracked by the frequency-locked magnetron RF system.

At operating gradient, the peak magnetic fields occur at the ends of the cell-to-cell coupling slots 42, among which the slot between cell 1 and cell 2 has the highest magnetic field, slot 5 between cell 5 and 6 has the lowest magnetic field. The peak magnetic field in slot 1 is 14% higher than in slot 5. Bmax with 3 MV/m accelerating field on axis is 22.2 mT.

The highest heat load in the cavity corresponds directly to the magnetic field. To estimate the temperature rise associated with this, the surface magnetic field map is scaled to the calculated power consumption of 38 kW (which includes a 15% margin for copper) and applied to a solid model in ANSYS.

Figure 8:
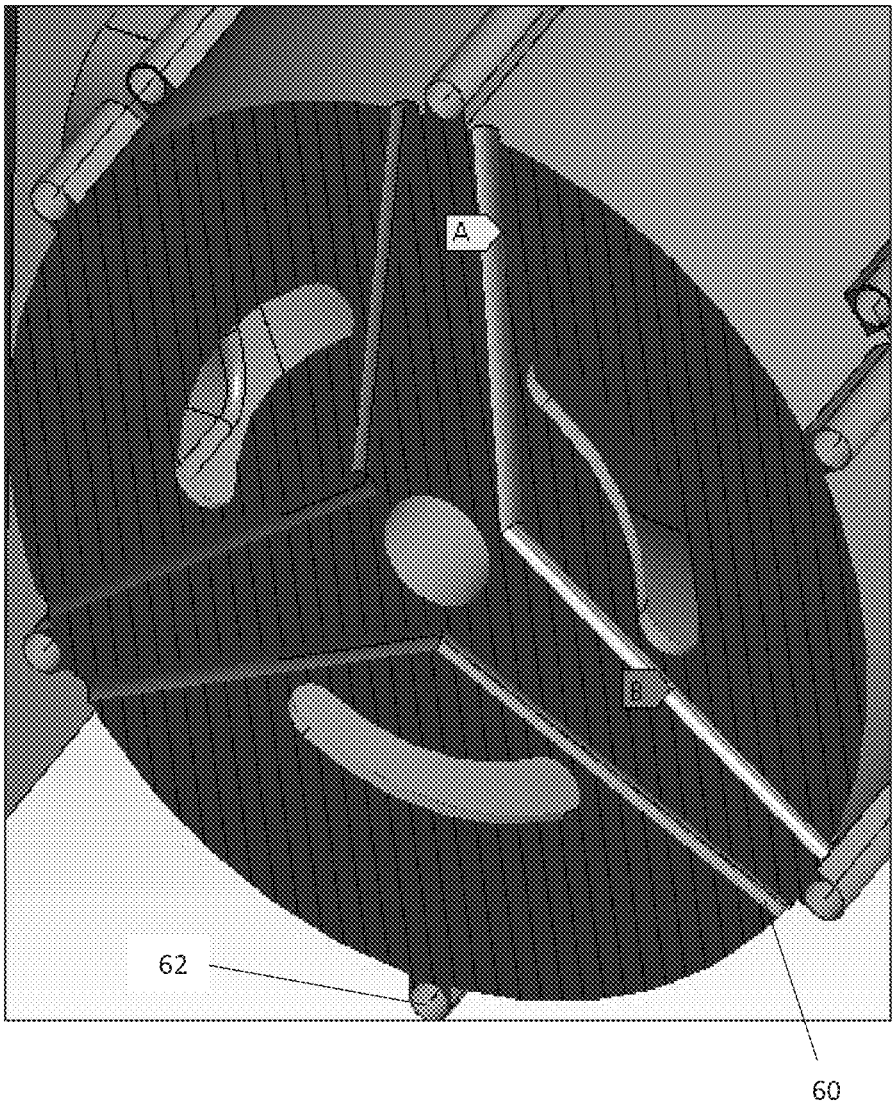
FIG. 8 is a perspective view of the cavity showing the internal and external cooling channels.

With reference to FIG. 8, in order to cool the cavity, cooling channels 60 are located between cells to target the hot-spots around the coupling slots. A further six external cooling channels 62 run the length of the cavity. The thermal calculation also assumed natural convection to ambient air on all outer surfaces. A mass flow model was used for the three internal individual cooling channels. A mass flow rate of 78 g/s with 30 C inlet water temperature was used. The flow rate for the outer circuits was 188 g/s.

The temperature on the exterior of the cavity is around 75 C. The hottest location in the cavity, 90 C, is on the nose 44 between the $5^{th}$ and $6^{th}$ cell and is caused by the proximity of the coupling ports to the waveguide. The water temperature on the internal cooling channels 40 increases by approximately 15 C from inlet to outlet.

The thermal solution was applied to a static structural model of the cavity to model the thermal expansion in all directions. The overall length of the cavity deformed by 0.5 mm end-to-end. The localized stress on the cavity was about 3500 psi on the outer cavity walls. The maximum stress found in the entire model is 4.8 ksi. Annealed OFC Cu (oxygen-free copper, which is a wrought high conductivity copper alloy that has been electrolitically refined to reduce the level of oxygen to 0.001% or below) has minimum yield strength of 10 ksi, therefore, the results are within an acceptable range.

RF Power System:

With reference to FIG. 7, an accelerator cavity according to the invention a high efficiency, scalable CW RF source based on commercial magnetrons which is an ideal match to this application at full power. The system will combine magnetrons, commonly used in the food processing industry, with Jefferson Lab's digital phase and amplitude control system to sum multiple 100 kW class magnetrons into a MW class source. For operation of this accelerator with about 500 kW of electron beam loading, a combiner scheme using six 100-125 kW magnetrons would be used to provide overhead for power losses. Rather than delivering this power through one high power coupler it is prudent to use at least two high power couplers 46, as illustrated in FIG. 7. This keeps the window power well within conservative limits.

The vacuum window 48 of the cavity must be able to transmit power to make up the wall losses in the cavity as well as power lost by the beam. The RF window is located near the cavity's sixth cell in a WR975 waveguide. The window is positioned a half wavelength away from the detuned short position, to avoid excessive electric field levels across the ceramic of the window as a result of large reflections after a sudden beam loss and help protect the window from damage due to arcing. The RF window is a scaled version of the high-power PEPII window, and has been matched to give the desired Qext of approximately 1000. The dimensions of the ceramic window 48 are tuned to make the S11 minimum be 915 MHz. The mode trapped inside the window was also investigated, being 911.056 MHz, safely away from the 915 MHz operating frequency. The tapered waveguide transition 50 between the window and cavity coupling slot is made simple for manufacturing, and also used to tune the coupling between the cavity and the waveguide. With the addition of the window being so close to the beam axis, there is an interconnection between the coupling and field flatness. The nose-cone trimming can again be used to return the flatness.

A summary of the cavity parameters is shown in Table 1. The overall wall plug to beam efficiency is estimated at about 70% when power supplies for magnets, diagnostics and vacuum systems are included. The average accelerating gradient of the structure is about 1 MV/m.

TABLE 1

| Cavity Parameters | |
|---|---|
| Fundamental frequency | 915 MHz |
| Peak on-axis gradient | 3 MV/m |
| Cavity power loss (inc. 15% overhead) | 38 kW |
| Power density (max) on surface | 123 W/cm$^2$ |
| Bmax at max gradient | 22.19 mT |
| Wall-plug to beam efficiency* | 76% |
| $Q_0$ | 18278 |
| Qexternal | 996.9 |
| Coupling factor | 18.25 |
| Max temperature with 30 C. water flow through cooling channel | 65 C. |

*defined as power delivered to the user by the beam as a fraction of wall power consumed (assuming 80% magnetron RF source efficiency).

Beam Break-Up Analysis:

At such high current beam break-up instabilities are a possibility, which could lead to beam losses in the structure or degradation of the beam quality. Initial simulations suggest almost all unwanted modes in this structure are safely below threshold. One calculated mode in the first cell, may require a damping antenna or nearby microwave absorbing material shielded from the fundamental mode.

Cavity Manufacture:

In the present invention, a primary consideration is that each cell can be manufactured using the same technique. There has been a focus on how to simplify the design and relax tolerances to reduce manufacturing costs. Each cell has the same outer diameter and the same radius but with different overall length. The length of the iris nose-cones between each cavity are individually trimmed for field flatness. Machining these parts from solid copper means that internal cooling channels can be drilled between each cell to target hot-spots. The structure will be brazed, so that there will be little deformation to the cavity shape during this process. The cavity will be tuned on the bench through an iterative process of nose-cone trimming, measuring, and benchmarking against simulation.

According to the current invention, it is technically feasible to envision a 0.5 MW, 1 MeV CW electron accelerator for the treatment of wastewater or other industrial applications. Advances in cavity design and pairing with a magnetron RF source significantly improve the efficiency of operation and cost of manufacture.

Although the invention has been explained in relation to its preferred embodiments as mentioned above, it is to be understood that many other possible modifications and variations can be made without departing from the scope of the present invention. It is, therefore, contemplated that future claims will cover such modifications and variations that fall within the true scope of the invention.

What is claimed is:

1. A 0.5 MW, 1 MeV CW normal conducting linear electron accelerator comprising:

a slot-coupled continuous wave (CW) graded beta (graded-β) standing wave accelerating cavity including a plurality of interconnected cells, a wall between each of said interconnected cells, and a plurality of non resonant coupling slots on the walls between said interconnected cells;

a magnetron RF delivery system including a plurality of magnetrons, said plurality of magnetrons having an 80% magnetron RF source efficiency;

an electron source including a gridded electron gun;

a solenoid magnet to focus an electron beam transversely into the accelerating cavity;

a wall plug to electron beam efficiency of at least 70%, said wall plug to electron beam efficiency defined as power delivered to the user by the beam as a fraction of wall power consumed; and a digital phase and amplitude control system to sum said plurality of magnetrons into a MW class source.

2. The normal conducting linear accelerator of claim 1, further comprising said electron source producing at least 0.5A of current.

3. The normal conducting linear accelerator of claim 1, further comprising said magnetron RF delivery system producing a 915 MHz signal.

4. The normal conducting linear accelerator of claim 1, comprising an RF bias applied to the gridded electron gun to produce a bunched beam.

5. The normal conducting linear accelerator of claim 1, comprising six of said plurality of interconnected cells forms a 6-cell cavity which accelerates the electron beam to at least 1 MeV.

6. The normal conducting linear accelerator of claim 5, comprising:

said plurality of interconnected cells in said 6-cell cavity are constructed of OFC copper (oxygen-free copper); and a quality factor $Q_0$ of the OFC copper cavity is at least 18278.

7. The normal conducting linear accelerator of claim 1, comprising one or more magnetic focusing quadrupole magnets to convert the electron beam to a flat beam transversely.

8. The normal conducting linear accelerator of claim 1, comprising the solenoid magnet focuses the electron beam into a cavity aperture of 2.8 cm diameter.

9. The normal conducting linear accelerator of claim 1, wherein said accelerating cavity comprises a graded-β cavity that operates at a phase near crest producing a 1 MeV beam having a peak on-axis field of 3 MV/m.

10. The normal conducting linear accelerator of claim 1, comprising at least one focusing magnet positioned surrounding the normal conducting linear accelerator contain the electron beam in the normal conducting linear accelerator.

11. The normal conducting linear accelerator of claim 1 comprising said plurality of magnetrons are 100 kW rated magnetrons.

12. The normal conducting linear accelerator of claim 11 comprising a combiner for combining the output of said plurality of magnetrons to provide 500 kW of electron beam loading.

* * * * *